United States Patent [19]

Lockaby

[11] Patent Number: 4,961,063

[45] Date of Patent: Oct. 2, 1990

[54] FUSE TUBE FOR POWER AND CUTOUT FUSES

[75] Inventor: Jerle Lockaby, Rome, Ga.

[73] Assignee: Specialized Hunting Equipment, Rome, Ga.

[21] Appl. No.: 448,708

[22] Filed: Dec. 11, 1989

[51] Int. Cl.[5] ..... H01H 85/30; H01H 71/10

[52] U.S. Cl. ..... 337/241; 337/168; 116/202

[58] Field of Search ..... 337/241, 242, 243, 245, 337/265, 266, 168, 169, 171; 116/200, 201, 202, 209

[56] References Cited

U.S. PATENT DOCUMENTS 3,684,348 8/1972 Rowland ..... 350/103
3,975,083 8/1976 Rowland ..... 350/103
3,997,862 12/1976 Kozacka et al. ..... 337/241

FOREIGN PATENT DOCUMENTS 2159 of 1902 United Kingdom ..... 337/243

*Primary Examiner*—H. Broome
*Attorney, Agent, or Firm*—John L. James

[57] ABSTRACT

A fuse tube is provided for cutout and power fuse assemblies. The fuse tube has a body with a red retroreflective portion and a white retroreflective portion. When conducting the red portion lies above the white portion. When the fuse blows, the white portion lies above the red portion. By observing whether the fuse tube has red over white or white over red, the condition of the fuse is determined. If the orientation is red over white, the fuse is all right. If the orientation is white over red, the fuse is dead, and needs to be replaced.

10 Claims, 1 Drawing Sheet

FUSE TUBE FOR POWER AND CUTOUT FUSES

TECHNICAL FIELD

This invention relates generally to circuit makers and breakers for an electrical distribution system, and more particulary relates to fuse assembly, especially fuse tubes for cutout fuses and power fuses.

BACKGROUND OF THE INVENTION

Protective devices are used to protect the power lines and power system equipment from damage caused by excessive voaltages and currents. One type of protective device is a fuse that functions to open a circuit when electric current in the circuit exceeds a predetermined level. A fuse cutout is a special kind of fuse that is used to protect equipment from burn out caused by heavy instantaneous fault currents or continuous overcurrents. The principle of the fuse cutout is essentially the same as that of the simple fuses found in the home. A small piece of soft conducting metal which melts at a very low temperature is placed in series with the line current so that an overload will heat the link causing it to break and form an open circuit.

In a power system, however, the current magnitude is so great that a more elaborate apparatus is needed to prevent violent and continuous arcing across the open contacts. Typically, an apparatus is used whereby the arc is extinguished and the distance between the contacts is greatly increased to prevent restrike. The fuse link itself, supported at both ends by a flexible pigtail conductor, is placed inside a tough fiber-lined tube. The lower end of the pigtail is sets a flipper latch spring and is wound around a bolt and secured by a nut. During a fault, the fuse link melts and a momentary high temperature arc results. A portion of the fiber lining then vaporizes forming a deionizing gas which dilutes and cools the conducting path of the arc with small non-conducting particles. The arc is then extinguished at the first current zero.

When the arc is disposed of, the flipper latch first prevents restriking by pulling the lower half of the broken pigtail out the bottom of the fuse tube. It is helped in this process by the exhaust blast of gases which tend to carry the link along. Second, the latch releases a toggle mechanism which drops the fuseholder straight down, freeing it from the upper contact. This allows the fuseholder to swing to a full 180 degree open position, providing easy identification of a fault interruption and also providing an added safety measaure against restriking. However, when the fuseholder swings down, it is difficult to detect from a viewing distance whether the fuse is electrically alive or dead. Accordingly, it will be appreciated that it would be highly desirable to have a fuse assembly that gives a highly visible indication of its electrical condition.

Because the fuse is positioned in the circuit to protect certain portions of the line and certain equipment, some fuses are placed in locations remote from the roadway. It is common for a pole mounted fuse to be mounted on the pole wherever the pole may be, whether it is a wooded area or an open field. It is common for a power line to run parallel or almost so with a roadway because houses that use electricity are located near the roadway. It is not uncommon when a workman is looking for the fuse that has operated to search for the fuse when it is dark because overcurrents occur at night, as well as, in the daytime. Overcurrents often occur during a thunderstorm. Weather conditions are seldom perfect when the workman is looking for the fuse that has operated. Thus, a workman may drive along the road and use a flashlight shined upon the assembly to locate the operated fuse.

An operated fuse can be identified by the position of the fuse tube. Unfortunately, the position of the fuse tube is difficult to see at night with only the aid of a flashlight, or in daylight after exposure to dirt and other contaminants. Accordingly, it will be appreciated that it would be highly desirable to have a fuse tube that is easy to see in all weather conditions and especially at night.

SUMMARY OF THE INVENTION

The present invention is directed to overcoming one or more of the problems set forth above. Briefly summarized, according to one aspect of the present invention, a fuse tube has a hollow body with first and second end portions. A first indicator is attached to the first end portion and a second indicator is attached to the second end portion.

The fuse tube houses a fusible link and it is an object of the present invention to provide an indication of the status of the fusible link. This object is achieved by the fuse tube which has a body portion with different indicators. The fuse tube is movable between an open position and a closed position, and the indicators move with the fuse tube between the open and closed positions to thereby indicate whether the fusible link is intact or separated.

Another object of the invention is to provide a fuse tube that is highly visible in the daytime during adverse weather conditions. This object is achieved by the fuse tube which has highly visible reflective indicators in colors that are highly visible in daylight even under adverse weather conditions.

Another object of the invention is to provide fuse tube that is visible at night with the aid of a flashlight. The fuse tube has indicators constructed of a retroreflective material that reflects light from a flashlight thereby making the indicator visible at night. The indicators remain highly reflective even after exposure to dirt and other contaminants.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENT

Figure 1:
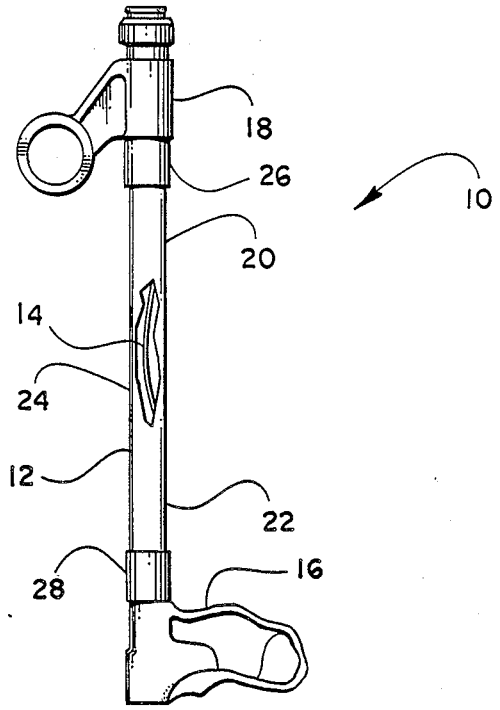
FIG. 1 is a simplified plan view of a preferred embodiment of a fuse tube illustrating its position when the fusible link intact according to the present invention.
Figure 2:
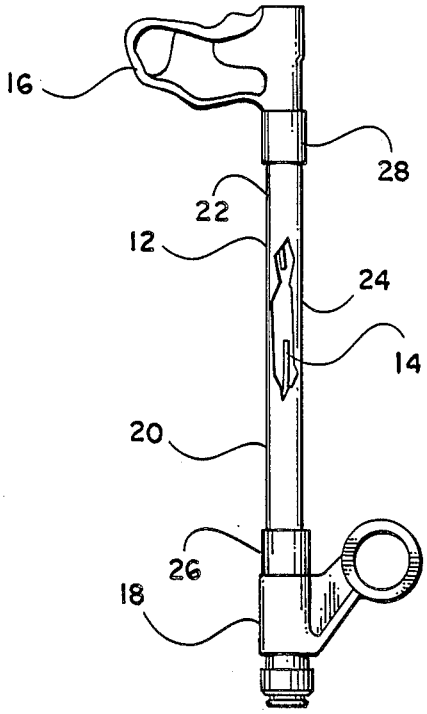
FIG. 2 is a simplified plan view of the fuse tube of FIG. 1, but illustrating its position when the fusible link separated.

Referring now to the drawings, in which like numerals indicate like elements throughout the several figures, FIGS. 1–2, a fuse assembly 10 is illustrated for controllably opening an electric circuit in response to an overcurrent condition. The fuse assembly 10 includes a hollow fuse tube 12, a fusible member 14 that is positioned inside the fuse tube 12, a flipper latch assembly 16 at the lower end of the fuse assembly 10, and a contact assembly 18 at the top of the fuse assembly 10.

The fuse tube 12 has a top end portion 20 adjacent the contact assembly 18 and a bottom end portion adjacent the latch assembly 16. Preferably, the fuse tube 12 is replaceably connected to the latch assembly 16 and contact assembly 18 so that the latch and contact assemblies 16, 18 may be used again after melting of the fusible link 14 and partial disintegration of the fuse tube 12. The fuse tube 12 has a middle portion 24 that extends between the top and bottom end portions 20, 22. The fuse tube 12 contains a status indicator formed of first and second indicators 26, 28.

The indicators 26, 28 are each preferably composed of two pieces of material, a base member and a top cover member. The base is preferably a composite retroreflective material that has a body portion and a plurality of cube corner formations. The retroreflective material is fully described in U.S. Pat. Nos. 3,684,348 and 3,975,083 which are incorporated herein by reference.

Briefly stated, the cube corner formations each have three planar faces which are disposed in planes perpendicular to each other and intersect along their side edges. The apex of each formation is vertically aligned with the center of the base of the cube corner formations. The cube corner formations are arranged in a pattern providing rows and columns, and the center-to-center spacing between the apexes of the cube corner formations along the rows and columns is in accordance with a regular pattern to insure close spacing and to substantially avoid any flat areas therebetween. The cube corner formations are so configured that a light ray entering the front surface of the material passes through the body portion and into a cube corner formation. When the light ray strikes one of the planar faces, it is directed to another of the planar faces, which in turn reflects the ray to a third planar face. The ray is then directed out of the cube corner formation in a return path so that its path back through the body and out is substantially parallel to its path of entry. This the principle of retroreflection. The top cover protects the cube corner formations from becoming clogged with dirt and debris that would render them ineffective in reflecting light. The top cover is sealed to the base along the edges thereof.

An adhesive backing may be applied to the indicators 26, 28 but, it is preferred that the indicators 26, 28 be applied to the fuse tube 12 with an industrial bonding agent, such as an epoxy resin or a liquid adhesive. The indicators 26, 28 can also be applied in the field by using liquid adhesive or epoxy resin instead of the adhesive backing. Also, cyanoacrylate or other reactive monomers may be used in the field. A slow drying or slow curing bonding agent can be advantageous because the slow curing time allows the components to be maneuvered into precise position after contact is made.

The first indicator 26 is preferably attached to the fuse tube 12 on the upper end portion 20 adjacent the contact assembly 18. The second indicator 28 is preferably attached to the fuse tube 12 on the lower end portion 22 adjacent the latch assembly 16. The indicators 26, 28 may extend toward one another covering both the end portions 20, 22 and middle portion 24 of the tube 12. There is a marked difference in the first and second indicators 26, 28 so that they are easily distinguishable in the field from a normal observation distance. Preferably they are different colors with the top indicator 26 being colored red and the bottom indicator 28 being colored white. Other colors may be used also; or, the reflectiveness of the indicators 26, 28 may be different to distinguish one from the other. The colors red and white are preferred because red is over white when the fuse is allright, but white over red means the fuse is dead.

It will be now appreciated that there has been presented a fuse assembly 10 that has a fuse tube 12 that is visible in day light and at night. The status of the fuse can be easily determined by the position of the fuse tube 12. The retroreflective components are easily attached to the tube 12 and form highly visible, very durable indicators so that the status of the fuse can be determined easily.

Operation of the present invention is believed to be apparent from the foregoing description and drawings, but a few words will be added for emphasis. In the normal closed circuit position, the fuse tube 12 is oriented with the upper end portion 20 above the lower end portion 22 so that the re first indicator 26 is over the white second indicator 28. In the normal position the fusible link 14 is intack and current can flow from the contact assembly 18, through the fusible link 14, and to the flipper latch assembly 16. When an overcurrent condition occurs, the fusible link 14 opens to interrupt the circuit and the fuse assembly 10 moves to the open position. In the open position, the fuse tube 12 hangs down and the upper end portion 20 is lower than the lower end portion 22. In the open position, the white second indicator 28 is above the red first indicator 26. When red is over white, it is allright, but when white is over red, the fuse is dead.

The indicators are simple in construction, easy to use and are very durable. The indicators withstand adverse weather conditions. They do not lose their retroreflectivity because the smooth cover element protects the reflecting cube corner formations from dirt and debris.

While the invention has been described with reference to a fuse tube, it is apparent that the invention is easily adapted to other devices that have parts that change positions between an open condition and a closed condition. While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

I claim:

1. A fuse tube, comprising: a hollow body having a first end portion, a second end portion, and a middle portion extending between said first and second end portions;

a first retroreflective indicator attached to said first end portion; and a second retroreflective indicator attached to said second end portion, said body is movable between a first position at which said first indicator is above said second indicator and a second position at which said indicator is above said first indicator.

2. A fuse tube, according to claim 1, wherein said first indicator is more reflective than said second indicator so that said first indicator is visibly distinguishable from said second indicator.

3. A fuse tube, comprising: a hollow body having a first end portion, a second end portion, and a midddle portion extending between said first and second end portions;

a first indicator attached to said first end portion, and a second indicator attached to said second end portion, said first indicator having a first color and said second indicator having a second color so that said first indicator is visibly distinguishable from said second indicator, said body is movable between a first position at which said first indicator is above said second indicator and a second position at which said indicator is above said first indicator.

4. A fuse tube according to claim 3, wherein said first indicator is colored red and said second indicator is colored white.

5. A fuse tube, according to claim 1, wherein said first indicator extends from said first end portion along said middle portion towards said second end portion.

6. A fuse tube, according to claim 1, wherein said second indicator extends from said second end portion along said middle portion towards said first end portion.

7. A fuse tube for housing a fusible link, comprising:

a body having a retroreflective first end portion, a retroreflective second end portion and a middle portion extending between said first and second end portions, said first end portion having a greater light reflectivity than said second end portion, said body being movable between a first position at which said fusible link is intact and said first end portion is above said second end portion, and a second position at which said fusible link is separated and said second end portion is above said first end portion.

8. A fuse tube for housing a fusible link, comprising:

a body having a retroreflective first end portion and a retroreflective second end portion, said first end portion having a first color and second end portion having a second color, said body being movable between a first position at which said fusible link is intact and said first end portion is above said second end portion, and a second position at which said fusible link is separated and said second end portion is above said end portion.

9. A fuse tube, according to claim 8, wherein said first color is red.

10. A fuse tube, according to claim 8, wherein said second color is white.

* * * * *